US008210011B2

(12) United States Patent
Muramatsu et al.

(10) Patent No.: US 8,210,011 B2
(45) Date of Patent: Jul. 3, 2012

(54) CONTINUOUS REPETITIVE ROLLING METHOD FOR METAL STRIP

(75) Inventors: Naokuni Muramatsu, Nagoya (JP); Ryota Takeuchi, Handa (JP); Tetsuo Sakai, Toyonaka (JP); Hiroshi Utsunomiya, Suita (JP)

(73) Assignees: NGK Insulators, Ltd., Nagoya (JP); Tetsuo Sakai, Suita (JP); Hiroshi Utsunomiya, Suita (JP)

( * ) Notice: Subject to any disclaimer, the term of this patent is extended or adjusted under 35 U.S.C. 154(b) by 0 days.

(21) Appl. No.: 12/874,498

(22) Filed: Sep. 2, 2010

(65) Prior Publication Data

US 2010/0326162 A1 Dec. 30, 2010

Related U.S. Application Data

(63) Continuation of application No. PCT/JP2009/050411, filed on Jan. 15, 2009.

(30) Foreign Application Priority Data

Mar. 7, 2008 (JP) ..... 2008-057646

(51) Int. Cl.
*B21B 13/00* (2006.01)
*B21B 13/16* (2006.01)

(52) U.S. Cl. ..... 72/234; 72/229; 72/366.2

(58) Field of Classification Search ..... 72/240, 72/249, 234, 229, 226, 366.2, 187, 365.2
See application file for complete search history.

(56) References Cited

U.S. PATENT DOCUMENTS

| | | | | | |
|---|---|---|---|---|---|
| 2,025,002 | A * | 12/1935 | McIlvried | 72/229 |
| 4,385,512 | A * | 5/1983 | Matsumoto et al. | 72/234 |
| 4,537,057 | A * | 8/1985 | Kajiwara et al. | 72/247 |
| 6,216,516 | B1 * | 4/2001 | Klamma et al. | 72/229 |
| 6,282,938 | B1 * | 9/2001 | Mertens et al. | 72/229 |
| 7,341,096 | B2 * | 3/2008 | Van Der Winden | 164/476 |
| 2008/0008901 | A1 * | 1/2008 | Sugiura et al. | 148/328 |

FOREIGN PATENT DOCUMENTS

| | | | |
|---|---|---|---|
| JP | 53-135861 | | 11/1978 |
| JP | 2004214100 | A * | 7/2004 |
| JP | 2004314100 | A * | 11/2004 |
| JP | 2007-146275 | | 6/2007 |

OTHER PUBLICATIONS

Sakai et al., "*Introduction of shear strain to aluminum alloy sheet and control of texture*", Journal of Japan Institute of Light Metals, vol. 52, No. 11 (2002), pp. 518-523 (with English Translation as authored by Applicant's Japanese representatives) (total pp. 22).

* cited by examiner

*Primary Examiner* — Edward Tolan
*Assistant Examiner* — Pradeep C Battula
(74) *Attorney, Agent, or Firm* — Burr & Brown

(57) ABSTRACT

A continuous repetitive method of rolling a series combination of asymmetric rolling and skin pass rolling operations is provided. Differential-speed rolling is performed as the asymmetric rolling, and a winder temporarily winds a metal strip with a collapsed plate shape by traverse winding (loose winding which allows the metal strip to be wound in a zigzag manner). Then, the skin pass rolling is performed, and orderly winding is performed in a coil form. In the flow of rolling, tandem rolling may be performed by arranging two or more rolling mills side by side so that the asymmetric rolling and the skin pass rolling operations are continuously performed without the traverse winding therebetween.

5 Claims, 5 Drawing Sheets

[111] pole figure

State of a shear deformation that is induced by asymmetric rolling

State of a compressive deformation that is induced by symmetric rolling

CONTINUOUS REPETITIVE ROLLING METHOD FOR METAL STRIP

FIELD OF THE INVENTION

The present invention relates to a continuous repetitive rolling method for a metal strip. The method is used when the metal strip is continuously and repetitively rolled under the asymmetric rolling condition that an upper-side rolling condition between an upper working roll and the metal strip and a lower-side rolling condition between a lower working roll and the metal strip are asymmetric.

BACKGROUND OF THE INVENTION

When shear deformation rolling is performed for a metal strip under asymmetric rolling condition that an upper-side rolling condition between an upper working roll and the metal strip and a lower-side rolling condition between a lower working roll and the metal strip are asymmetric, a unique rolling texture that is induced by the shear deformation develops. For example, the rolling method with the shear deformation under the asymmetric rolling condition may be a differential-speed rolling method (see Non-patent document 1) in which a pair of upper and lower rolls rotate at different speeds, or a rolling method in a state in which interfaces between a pair of rolls and a metal plate member have different friction coefficients (see Patent document 1).

Non-Patent Document 1: Tetsuo Sakai, Hiroshi Utsunomiya, and Yoshihiro Saito, "Aluminium-ban e no sendan-henkei no dounyu to shugo-soshiki no seigyo (Introduction of shear strain to aluminum alloy sheet and control of texture)," Keikinzoku (Light metal), Journal of the Japan Institute of Light Metals, November 2002, Vol. 52, No. 11, pp. 518-523

Patent Document 1: Japanese Unexamined Patent Application Publication No. 53-135861

SUMMARY OF THE INVENTION

However, if the asymmetric rolling with shear deformation is continuously and repetitively performed in order to induce shear deformation to the metal strip, the plate shape, in particular, the flatness of the metal strip, is likely to be degraded. For example, the plate shape may be collapsed such that the strip is markedly curved lengthwise, the strip is markedly waved widthwise (see FIG. 7), and the strip surface becomes rough and matt (see FIG. 8). Consequently, when an unwinder and a winder are arranged with a rolling mill interposed therebetween, the metal strip may meander in an area between the unwinder and the winder, and the metal strip may be defectively wound during winding in a coil form. Thus, it has been difficult to perform continuous repetitive asymmetrical rolling.

To overcome the above difficulty, a method may be conceived that rolls a metal strip while a tension is applied to the metal strip. However, to sufficiently obtain a correction effect, a certain tension device has to be added to the unwinder or the winder. It is extremely difficult in an economical and a technical sense to perform the controlled rolling while the balance of the metal strip is maintained during unwinding, asymmetric rolling, and winding operations. In addition, if the rolled shape is bad and the balance is disturbed, the metal strip no longer resists the tension properly and the metal strip may fracture.

The present invention is made in light of the situations, and a main object of the invention is to obtain a metal strip having a certain flatness that allows the metal strip to be easily wound without an increase in rolling load while maintaining a shear texture.

The inventors studied this problem with dedication in order to obtain a metal strip having a certain flatness that allows the metal strip to be easily wound without an increase in rolling load while the shear texture is also maintained. For example, the inventors performed asymmetric rolling and then symmetric rolling under various conditions (the symmetric rolling in this case may be a method of rolling with upper and lower rolls at equivalent speeds in a lubricated state typically provided by a person skilled in the art). As a result, it was found that the plate shape was corrected and the flatness was recovered if the strip thickness was decreased by a sufficient amount until the strip thickness of the entire strip became uniform by simply performing symmetric rolling.

However, with the method easily expected from the related art, it was also found that the rolling texture unique to the shear deformation (hereinafter, referred to as "shear texture;" see FIG. 9) was broken, the shear deformation (see FIG. 10) induced to the entire region in the strip-thickness direction was significantly broken in an area near the surface, and the texture was brought back to a compressive deformation state (see FIG. 11) induced by the conventional symmetric rolling. Further, the rolling force (also called rolling load) required for the symmetric rolling was twice or more the rolling force required for asymmetric rolling. Accordingly, the load on the rolling mill was increased.

Then, the inventors further studied with dedication an improvement, and a good result was obtained if slight rolling (so-called skin pass rolling) was performed under a condition that a reduction in strip thickness was within a range from 3% to 10% when the plate shape was corrected by the symmetric rolling. Furthermore, the combined condition of a driving torque (G), a working roll radius (R), and a rolling load (P) was considered. As a result, it was found that the flatness was recovered without the shear texture being broken (see FIG. 1), and a defective effect to the strip surface was suppressed to be negligible if a friction coefficient $\mu$ ($\mu$=G/RP) between the working rolls and the metal strip was adjusted to be within a range from 0.05 to 0.12 while the reduction in strip thickness was maintained within the range from 3% to 10%.

On the basis of the finding, the respective conditions were studied. As a result, a skin pass rolling method for a metal strip according to the present invention was made, the metal strip having a flatness that allows the metal strip to be easily wound without an increase in rolling load while a shear texture is maintained which had not been achieved by the expected conventional method. In addition, by properly combining asymmetric rolling with symmetric rolling, a continuous repetitive rolling method for a metal strip according to the present invention is made.

A continuous repetitive rolling method for a metal strip according to the present invention includes the step of performing rolling with shear deformation one time under asymmetric rolling condition that an upper-side rolling condition between an upper working roll and the metal strip and a lower-side rolling condition between a lower working roll and the metal strip are asymmetric, and then performing skin pass rolling one time such that a reduction in strip thickness is within a range from 3% to 10% under a symmetric rolling condition that the upper-side rolling condition and the lower-side rolling condition are symmetric.

With the continuous repetitive rolling method for the metal strip according to the present invention, the flat metal strip, which is easily wound in a coil form while the induced shear texture is maintained without the increase in rolling load, can be continuously and repetitively rolled. In this case, economic and technical loads are not increased.

DETAILED DESCRIPTION OF THE INVENTION

Figure 2:
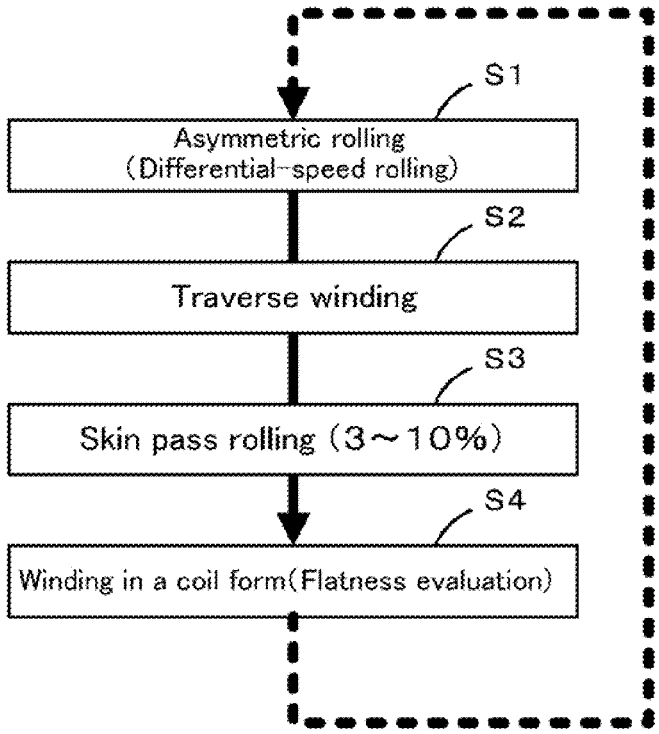
FIG. 2 is a flowchart showing a continuous repetitive rolling method according to the present invention.
Figure 3:
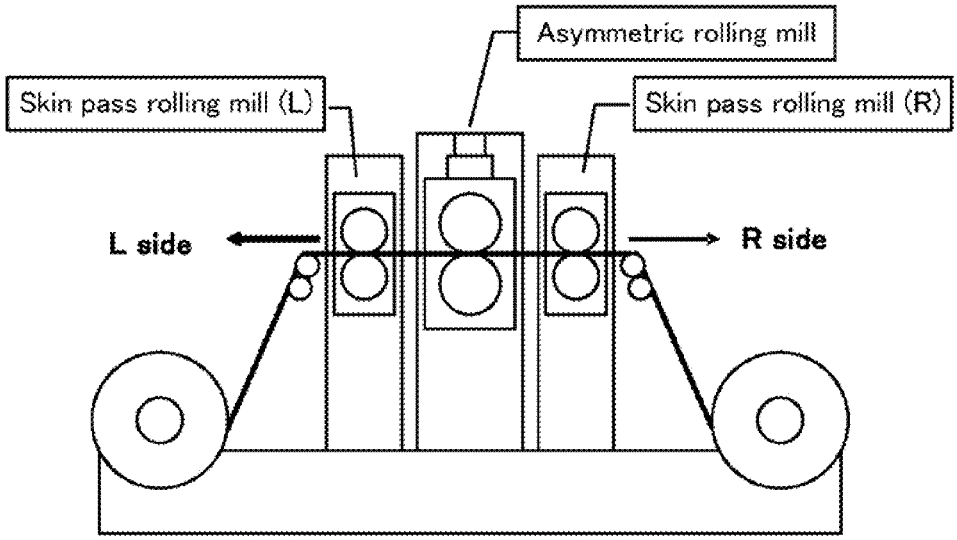
FIG. 3 is an explanatory view showing a tandem mill with a three-rolling-mills configuration.
Figure 4:
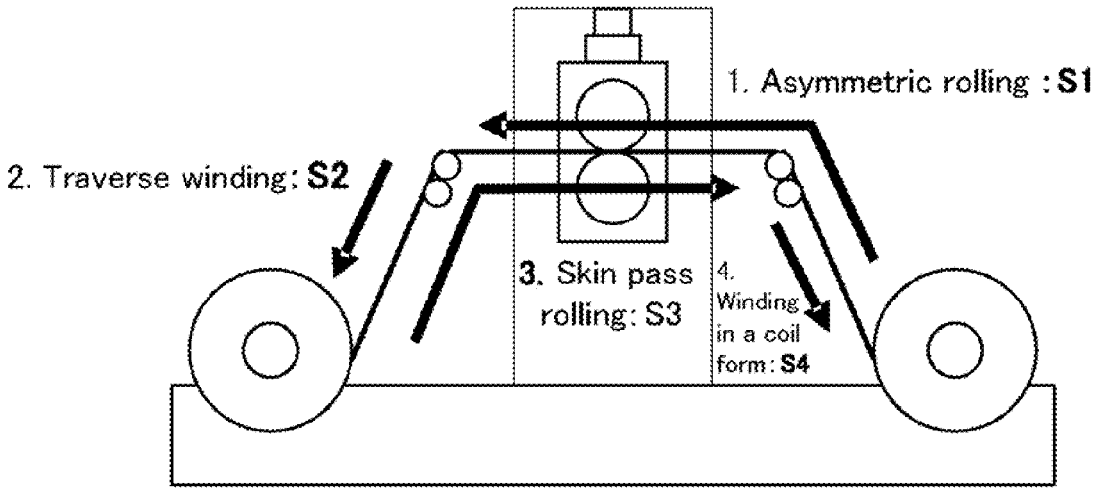
FIG. 4 is an explanatory view when a single rolling mill alternately and repetitively performs rolling with shear deformation and skin pass rolling.

A preferred embodiment of the present invention will be described below. FIG. 2 illustrates a flow of rolling with a combination of asymmetric rolling (S1) and skin pass rolling (S3). Differential-speed rolling is performed as the asymmetric rolling, and a winder temporarily winds a metal strip with a collapsed plate shape by traverse winding (loose winding which allows the metal strip to be wound in a zigzag manner: S2). Then, the skin pass rolling is performed, and orderly winding is performed in a coil form (S4). As shown in the flow of rolling, tandem rolling may be performed by arranging two or more rolling mills side by side so that the asymmetric rolling and the skin pass rolling are continuously performed without the traverse winding (S2) in the mid course. FIG. 3 is an explanatory view showing a tandem mill with a three-rolling-mill configuration. With this tandem mill, continuous rolling can be performed, in which the asymmetric rolling and the skin pass rolling are arranged in tandem. Thus, shear rolling can be performed to either of the L side or the R side while the flatness is continuously maintained. It is to be noted that an upper roll of an R rolling mill is moved upward when the rolling is performed to the L side, and an upper roll of an L rolling mill is moved upward when the rolling is performed to the R side. FIG. 4 is an explanatory view when a single rolling mill alternately and repetitively performs rolling with shear deformation and skin pass rolling. This rolling mill performs the rolling with shear deformation under the asymmetric rolling condition that the upper-side rolling condition between the upper working roll and the metal strip and the lower-side rolling condition between the lower working roll and the metal strip are asymmetric. The obtained metal strip is temporarily wound by traverse winding. Then, the skin pass rolling is performed under a symmetric rolling condition that the upper-side rolling condition and the lower-side rolling condition are symmetric. More specifically, steps S1 to S4 are repeated.

The skin pass rolling (S3) is preferably performed such that a reduction in strip thickness is within a range from 3% to 10%. As long as that thickness range is satisfied, the shear texture is not broken by the compressive deformation by the symmetric rolling, and the state of the induced shear deformation is not collapsed, even in an area near the strip surface.

Slight rolling with the reduction in strip thickness being less than 3% has difficulty in control of the strip thickness, and does not provide a correction effect for the plate shape. Even if such rolling is repeated two or more times, the rolling is not efficient or economically advantageous.

In contrast, rolling with the reduction in strip thickness being more than 10% provides the correction effect for the strip thickness; however, the shear texture is significantly broken. This results in the state of the shear deformation being collapsed in the area near the strip-thickness surface. In addition, a required rolling load is increased, and the rolling load may exceed the capacity of the mill depending on the thickness and the width of the strip.

The skin pass rolling (S3) is preferably performed such that a friction coefficient μ between the working rolls and the metal strip during rolling is within a range from 0.05 to 0.12. The reason for this limitation will be described below. The friction coefficient μ between the working rolls and the metal strip during rolling is determined as a numerical value (G/RP) obtained such that a driving torque G applied to the rolls is divided by a roll radius R and a rolling force P. Normally, since a roll radius R is not easily changed in a rolling mill, the roll radius R is spontaneously fixed. Thus, the friction coefficient μ is actually determined by adjusting the balance between the driving torque G and the rolling force P. By selecting the driving torque G and the rolling force P such that the friction coefficient μ is within the range from 0.05 to 0.12, the skin pass rolling can be performed such that a component of shear rolling is balanced with a component of compressive rolling. If the range is satisfied, the reduction in strip thickness can be controlled to be within the range from 3% to 10% by one-time rolling. The shear texture and the shear deformation in the area near the strip surface were not broken after the skin pass rolling.

If the friction coefficient μ is smaller than 0.05, in particular, if the rolling force P is extremely large with respect to the driving torque G, the component of the compressive rolling becomes large. The reduction in strip thickness by one-time rolling likely exceeds 10%. Also, the shear texture is likely broken. In particular, the shear deformation is likely broken in the area near the strip surface.

If the friction coefficient μ is larger than 0.12, in particular, if the driving torque G is extremely large with respect to the rolling force P, the component of the shear rolling still becomes large in the area near the surface of the metal strip. The correction effect for the plate shape is not obtained, and the reduction in strip thickness by one-time rolling may become uneven depending on a portion in the strip. The strip may have a portion with a reduction in strip thickness exceeding 10%, and a portion with a reduction in strip thickness being 10% or lower.

EXAMPLES

Preferred examples of the present invention will be described below. It should be noted that the present invention is not limited to the examples, and may be implemented in various forms within the technical scope of the present invention.

Figure 7:
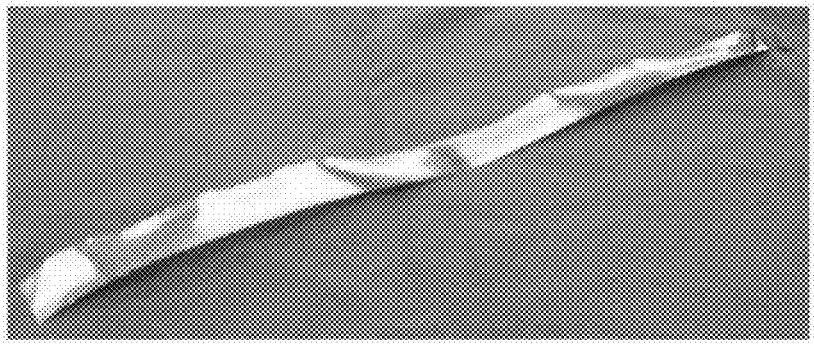
FIG. 7 is a photograph showing a strip shape according to related art.
Figure 8:
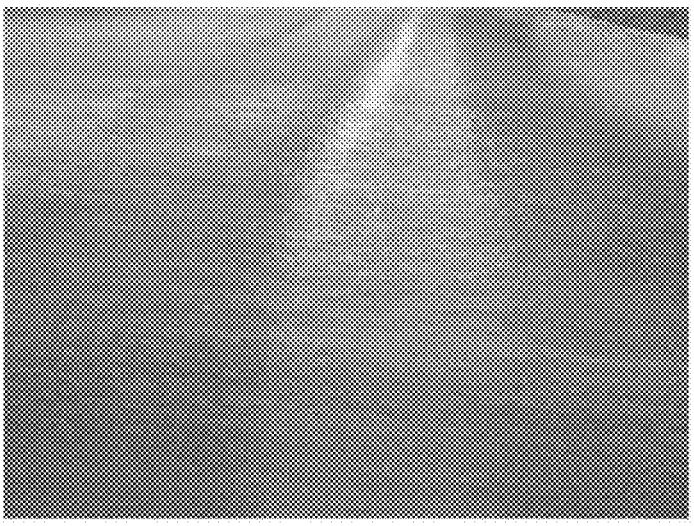
FIG. 8 is a photograph showing a strip surface state according to the related art.
Figure 9:
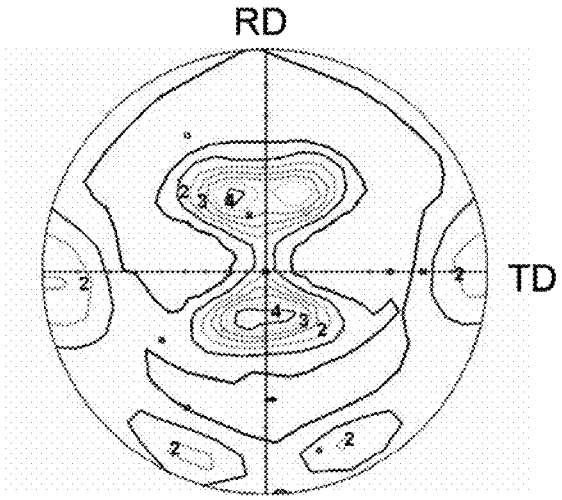
FIG. 9 is a {111} pole figure showing a shear texture according to the related art.
Figure 10:
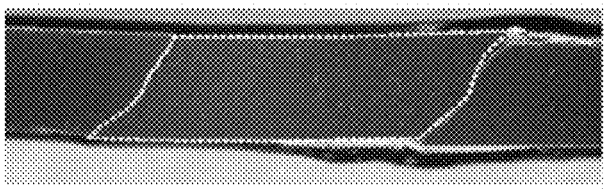
FIG. 10 is a cross-sectional view cut along a longitudinal direction showing a state of a shear deformation that is induced by asymmetric rolling.
Figure 11:
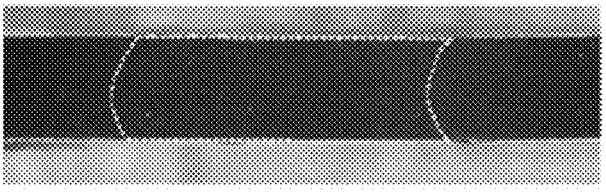
FIG. 11 is a cross-sectional view cut along the longitudinal direction showing a state of a compressive deformation that is induced by symmetric rolling.

Experiments were performed according to Examples 1 to 7 and Comparative examples 1 to 5. In each of the examples and the comparative examples, a metal strip used for rolling was an industrial copper beryllium strip (JIS H3130 C1720R) with a width of 50 mm, and asymmetric rolling was performed with upper and lower rolls at different speeds for the strip wound in a coil form by a quantity of about 30 Kg, to reduce the thickness of the strip from 1 mm to 0.27 mm. FIG. 7 shows a plate shape and FIG. 9 shows a shear texture in this case.

Figure 1:
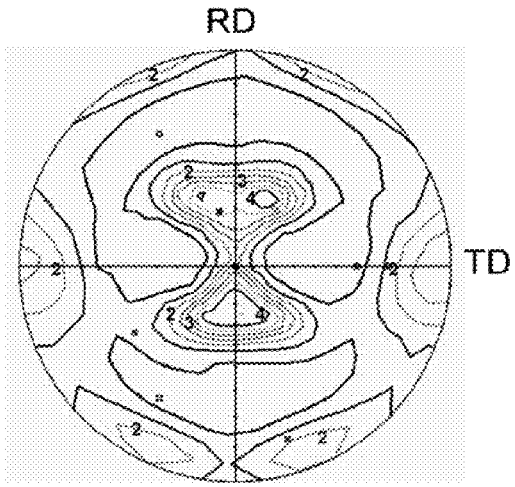
FIG. 1 is a {111} pole figure showing a shear texture after skin pass rolling according to an example of the present invention.
Figure 5:
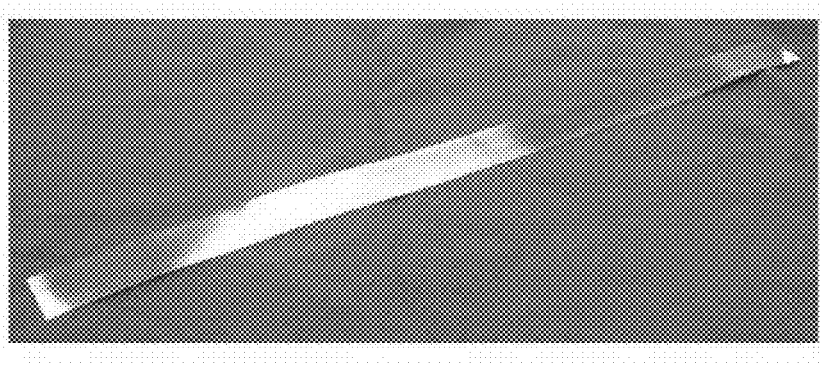
FIG. 5 is a photograph showing a strip shape after the skin pass rolling according to the example of the present invention.
Figure 6:
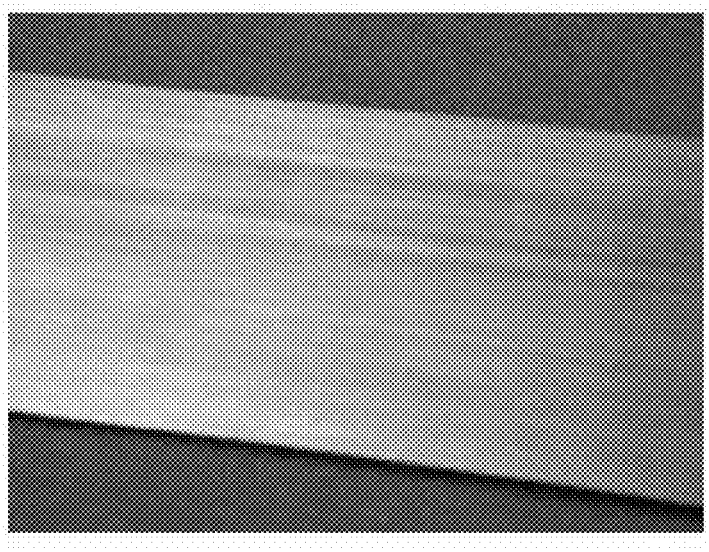
FIG. 6 is a photograph showing a strip surface state after the skin pass rolling according to the example of the present invention.

The metal strip was temporarily wound by traverse winding, and then skin pass rolling, i.e., symmetric rolling was performed by the same rolling mill. The skin pass rolling was performed under different conditions depending on the examples and the comparative examples. Table 1 shows the conditions. Referring to Table 1, the considered conditions included (1) reduction in strip thickness, (2) driving torque, (3) roll radius, (4) rolling weight, and (5) friction coefficient. The roll radius was not changed, and a uniform value was used. For example, in Example 2, conditions including driving torque G=1.125 kW (1125 Nm), roll radius R=67.5 mm (0.0675 m), and compressive force P=157 kN (157000 N) were selected, and rolling was performed one time with a friction coefficient μ (=G/RP)=0.106. The strip thickness after the skin pass rolling was reduced by 6% as compared with the thickness before the skin pass rolling, and became 0.254 mm. The plate shape was corrected as shown in FIG. 5 after the skin pass rolling. Also, the shear texture was maintained as shown in FIG. 1. The strip surface was improved to a smooth surface as shown in FIG. 6. As it is understood through the structure of the rolling mill, a compressive force (compressive load) P applied during the skin pass is adjusted by adjusting a gap between upper and lower rolls, and is actually controlled by determining a gap that provides a proper rolling force.

ing as the rolling load, was obtained such that an output signal was measured by a load cell installed in advance in the rolling mill, and the output signal was converted into a load by A/D conversion.

Table 1 shows the characteristics of the metal strips obtained according to the examples and the comparative examples. The considered characteristics of the obtained metal strips included (6) flatness (visual judgment), (7) shear texture (pole figure), (8) strip surface state (touch), (9) surface roughness Ra, and (10) collapsed winding. More specifically, the flatness of (6) was judged by setting the metal strip, which has been cut into a piece with a length of about 1000 mm after the skin pass rolling, on a surface plate, and by visually checking the plate shape of the metal strip. The flatness was judged good if the height of the piece was smaller than 50 mm (5%), or bad if not. The shear texture of (7) was judged by looking a collapsed state in the measurement result using the pole figure. The shear texture was judged good depending on an intensity of the texture in a {111}<110> component as the typical shear texture. In other words, the shear texture was judged good if a region of a contour 3 or of higher in the pole figure was not lost and still remained, or bad if not. The strip surface state (8) was evaluated in a sensory manner whether the surface was matt or smooth by touching the strip surface. An arithmetic average roughness Ra (μm) of (9) was measured by using a stylus-type surface roughness tester defined in JIS B 0651, under the standard of a surface roughness defined in JIS B 0601. The arithmetic average roughness Ra provides auxiliary determination for the surface smoothness. With the auxiliary determination, the improvement effect was determined. The collapsed winding of (10) was visually checked when the metal strip was wound around an iron ring with an inner diameter of 300 mm by an automatic winder immediately after the skin pass rolling. Referring to Table 1, Examples 1 to 7 provided satisfactory results for all of the characteristics (6) to (10); while, Comparative examples 1 to 5 did not provide satisfactory results for all of the characteristics.

TABLE 1

| | | (1) Reduction in strip thickness (%) | (2) Driving torque G(kNm) | (3) Roll radius R(m) | (4) Rolling load P(kN) | (5) Friction coefficient μ = G/RP | (6) Flatness (visual judgement) | (7) Shear texture (pole figure) | (8) Strip surface state (touch) | (9) Surface roughness Ra(μm) | (10) Collapsed winding (Collapsed or not collapsed) |
|---|---|---|---|---|---|---|---|---|---|---|---|
| Examples | 1 | 3 | 0.63 | 0.0675 | 98 | 0.095 | Good | Good | Smooth | 0.302 | Not collapsed |
| | 2 | 6 | 1.13 | 0.0675 | 157 | 0.107 | Good | Good | Smooth | 0.324 | Not collapsed |
| | 3 | 7 | 1.17 | 0.0675 | 145 | 0.120 | Good | Good | Smooth | 0.331 | Not collapsed |
| | 4 | 10 | 0.59 | 0.0675 | 161 | 0.054 | Good | Good | Smooth | 0.305 | Not collapsed |
| | 5 | 4 | 0.98 | 0.0675 | 123 | 0.118 | Good | Good | Smooth | 0.328 | Not collapsed |
| | 6 | 9 | 0.54 | 0.0675 | 154 | 0.052 | Good | Good | Smooth | 0.299 | Not collapsed |
| | 7 | 5 | 0.86 | 0.0675 | 82 | 0.119 | Good | Good | Smooth | 0.334 | Not collapsed |
| Comparative examples | 1 | 15 | 1.06 | 0.0675 | 349 | 0.045 | Good | Collapsed | Smooth | 0.328 | Not collapsed |
| | 2 | 23 | 2.25 | 0.0675 | 271 | 0.123 | Good | Collapsed | Smooth | 0.311 | Not collapsed |
| | 3 | 11 | 0.96 | 0.0675 | 290 | 0.049 | Good | Collapsed | Smooth | 0.333 | Not collapsed |
| | 4 | 2 | 0.27 | 0.0675 | 27 | 0.148 | Bad | Good | Matt | 0.422 | Collapesed |
| | 5 | 2 | 0.09 | 0.0675 | 28 (Lubricant) | 0.047 | Bad | Good | Matt | 0.466 | Collapesed |

In Comparative example 4, since a rolling load was excessively decreased to suppress a reduction in plate thickness, (a torque was also decreased, and) a friction coefficient became μ > 0.12.
In Comparative example 5, since a lubricant was applied to suppress a reduction in plate thickness, a friction coefficient μ was excessively decreased.

The driving torque G, the roll radius R, and the compressive force P were obtained as follows. The torque G was obtained such that a torque component vector instruction value generated in a driving motor was extracted with a direct voltage, and the torque G was calculated by using a ratio of the extracted value to a rated current. The roll radius R was measured by a vernier caliper. The compressive force P, serv- This application is based on and claims priority from Japanese Patent Application No. 2008-057646 filed Mar. 7, 2008, which is hereby incorporated by reference herein in its entirety.

Industrial Applicability

The present invention can be used for a metal working technique.

The invention claimed is:

1. A continuous repetitive rolling method for a metal strip, comprising the steps of:

performing a series of operations multiple times, each series of operations consisting of (i) performing rolling with shear deformation one time under asymmetric rolling condition that an upper-side rolling condition between an upper working roll and the metal strip and a lower-side rolling condition between a lower working roll and the metal strip are asymmetric, and (ii) then performing skin pass rolling one time such that a reduction in strip thickness is within a range from 3% to 10% under symmetric rolling condition that the upper-side rolling condition and the lower-side rolling condition are symmetric, wherein the rolling with shear deformation under asymmetric rolling condition is either differential-speed rolling in which the upper and lower working rolls rotate at different speeds or a rolling in a state which interfaces between the upper and lower working rolls and the metal strip have different friction coefficients.

2. The rolling method according to claim 1, wherein performing skin pass rolling one time such that the reduction in strip thickness is within the range from 3% to 10% under the symmetric rolling condition that the upperside rolling condition and the lower-side rolling condition are symmetric, the symmetric rolling condition comprises friction coefficient between the working rolls and the metal strip during rolling that is within a range from 0.05 to 0.12, where a dimensionless number is obtained by =G/RP, being a friction coefficient between the working rolls and the metal strip, G (Nm) being a driving torque applied to the working rolls, R (m) being a roll radius, P (N) being a rolling load.

3. The rolling method according to claim 1, wherein the asymmetric rolling and the skin pass rolling are alternately repeated.

4. The rolling method according to claim 1, wherein continuous rolling is performed, in which the asymmetric rolling and the skin pass rolling are arranged tandem, and the continuous rolling is repeated a plurality of times.

5. The rolling method according to claim 1, wherein the rolling with shear deformation is performed under the asymmetric rolling condition that an upper-side rolling condition between the upper working roll and the metal strip and a lower-side rolling condition between the lower working roll and the metal strip are asymmetric, the obtained metal strip is temporarily wound by traverse winding, and the skin pass rolling is performed under the symmetric rolling condition between the upper and lower rolls.

* * * * *